US011443882B2

(12) United States Patent
Hoffmann et al.

(10) Patent No.: US 11,443,882 B2
(45) Date of Patent: Sep. 13, 2022

(54) COIL DEVICE

(71) Applicant: Siemens Aktiengesellschaft, Munich (DE)

(72) Inventors: Ingolf Hoffmann, Herzogenaurach (DE); Stephan Rückert, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 844 days.

(21) Appl. No.: 16/327,096

(22) PCT Filed: Aug. 8, 2017

(86) PCT No.: PCT/EP2017/070011
§ 371 (c)(1),
(2) Date: Feb. 21, 2019

(87) PCT Pub. No.: WO2018/036805
PCT Pub. Date: Mar. 1, 2018

(65) Prior Publication Data

US 2019/0180907 A1 Jun. 13, 2019

(30) Foreign Application Priority Data

Aug. 25, 2016 (EP) ..... 16185586

(51) Int. Cl.
*H01F 27/08* (2006.01)
*H01F 27/10* (2006.01)
(Continued)

(52) U.S. Cl.
CPC ..... *H01F 27/10* (2013.01); *H01F 27/2876* (2013.01); *H01F 27/32* (2013.01); *H01F 37/00* (2013.01)

(58) Field of Classification Search
CPC ..... H01F 27/2876; H01F 27/10
(Continued)

(56) References Cited

U.S. PATENT DOCUMENTS 6,157,282 A * 12/2000 Hopkinson ..... H01F 27/10 336/60
7,245,197 B2 * 7/2007 Helosvuori ..... H01F 27/10 336/60
(Continued)

FOREIGN PATENT DOCUMENTS

CN 201466976 U 5/2010 ..... H02M 3/24
CN 202905379 U 4/2013 ..... H01F 27/10
(Continued)

OTHER PUBLICATIONS

Chinese Office Action, Application No. 201780051258.6, 7 pages, dated Sep. 3, 2020.
(Continued)

*Primary Examiner* — Ronald Hinson
(74) *Attorney, Agent, or Firm* — Slayden Grubert Beard PLLC

(57) ABSTRACT

Various embodiments include a coil device for a power converter, the device comprising: a cooling plate; and a plurality N≥3 of coil windings. The cooling plate is thermally coupled to at least one end face of one of the plurality of coil windings. The coil windings are spatially offset from one another by an angle of 2π/N. The cooling plate defines a cooling channel extending at least partially around each of the plurality of coil windings.

15 Claims, 4 Drawing Sheets

(51) Int. Cl.
*H01F 27/28* (2006.01)
*H01F 37/00* (2006.01)
*H01F 27/32* (2006.01)

(58) Field of Classification Search
USPC ..... 336/60
See application file for complete search history.

(56) References Cited

U.S. PATENT DOCUMENTS

| | | | | |
|---|---|---|---|---|
| 8,089,330 | B2 * | 1/2012 | Wen | H01F 27/306 336/55 |
| 8,963,677 | B2 * | 2/2015 | Xu | H01F 27/26 336/213 |
| 2010/0232181 | A1 * | 9/2010 | Nakahori | H01F 27/2804 363/17 |
| 2011/0075368 | A1 | 3/2011 | Stoev | 361/699 |
| 2011/0156851 | A1 * | 6/2011 | Honna | H01F 27/255 336/5 |
| 2011/0267161 | A1 | 11/2011 | Maclennan et al. | 336/58 |
| 2012/0146753 | A1 * | 6/2012 | Lukso | H01F 30/12 336/5 |
| 2013/0009737 | A1 * | 1/2013 | Rocke | H01F 29/14 336/5 |
| 2014/0028427 | A1 * | 1/2014 | Navarro | H01F 27/32 336/61 |
| 2014/0292455 | A1 * | 10/2014 | Kurita | H01F 30/12 336/5 |
| 2015/0084732 | A1 * | 3/2015 | Lim | H01F 41/06 425/117 |
| 2015/0097644 | A1 * | 4/2015 | Shepard | H01F 41/02 336/60 |
| 2015/0102881 | A1 * | 4/2015 | Giengiel | H01F 37/00 336/5 |
| 2015/0109085 | A1 * | 4/2015 | Weber | H01F 29/025 336/170 |

FOREIGN PATENT DOCUMENTS

| | | | | |
|---|---|---|---|---|
| CN | 204537811 | U | 8/2015 | F25B 21/02 |
| CN | 204884782 | U | 12/2015 | H01F 25/10 |
| DE | 10 2012 217 607 | A1 | 3/2014 | F28F 21/06 |
| EP | 1 564 762 | A2 | 8/2005 | H01F 27/10 |
| EP | 2 977 996 | A1 | 1/2016 | H01F 27/10 |
| JP | 07307226 | A | 11/1995 | F25D 9/00 |
| SU | 838773 | A1 | 6/1981 | H01F 27/10 |
| WO | 2009/143643 | A1 | 12/2009 | H01F 27/16 |
| WO | 2011/039417 | A1 | 4/2011 | H01F 27/10 |
| WO | 2018/036805 | A1 | 3/2018 | H01F 27/10 |

OTHER PUBLICATIONS

Extended European Search Report, Application No. 16185586.1, 8 pages, dated Feb. 17, 2017.
International Search Report and Written Opinion, Application No. PCT/EP2017/070011, 25 pages, dated Nov. 17, 2017.

* cited by examiner

COIL DEVICE

CROSS-REFERENCE TO RELATED APPLICATIONS

This application is a U.S. National Stage Application of International Application No. PCT/EP2017/070011 filed Aug. 8, 2017, which designates the United States of America, and claims priority to EP Application No. 16185586.1 filed Aug. 25, 2016, the contents of which are hereby incorporated by reference in their entirety.

TECHNICAL FIELD

The present disclosure relates to coil devices. Various embodiments may include a coil device for a power converter.

BACKGROUND

There are various coil devices, e.g. choking coils, wound from a plurality of layers of an insulated conductor. Due to the electrical loading of a coil device, thermal losses occur e.g. within the windings of the coil device or in its coil core, which is made of e.g. iron. The individual windings of the coil device are typically electrically insulated from each other by the introduction of an insulating material. Adequate heat dissipation of the coil device must be ensured in this type of configuration. A preferred heat dissipation or cooling of the coil device or winding layers thereof is based on contact dimensioning, such that the predetermined structural space can as far as possible be optimally utilized. In order to achieve this, e.g. a cooling plate is incorporated in the coil device, it being necessary in particular to electrically insulate said cooling plate from a yoke of a winding of the coil device. The incorporation of a cooling plate, in particular a metallic cooling plate, in the coil device is however disadvantageous in that, due to the magnetic fields which occur, electric currents are induced in said coil device and result in losses (ohmic losses caused by eddy currents).

Some include water coolers which are used for choking coils in particular and are based on the incorporation of metallic heat sinks in the coil device and/or hollow conductors which are used for the windings of the coil device. A coolant can be routed through the hollow conductors and dissipate the heat of the coil device.

DE 10 2012 217 607 A1 describes cool bags made of synthetic material and having a Y-structure which can be incorporated in the coil device or a winding thereof. In order to increase the thermal conductivity between the windings of the coil device and the cited Y-structure, these are at least partially embedded in a resin such that air entrapment can be reduced or ideally prevented. Also disclosed is the complete encapsulation of coil devices, in particular choking coils, such that improved internal thermal conductivity is achieved.

EP 2977996 A1 describes a choking coil of a power converter, said choking coil comprising a hollow cylindrical coil winding that has a cooling plate thermally attached to its base. This type of configuration has the disadvantage that eddy currents develop within the cooling plate, resulting in losses. It is moreover apparent that cooling of the cooling plate for the purpose of heat dissipation is technically difficult.

SUMMARY

The teachings of the present invention describe a coil device having improved cooling. For example, some embodiments include a coil device (1) for a power converter, comprising a cooling plate (2) and a plurality N≥3 of coil windings (4), wherein the cooling plate (2) is thermally coupled to at least one end face (400) of one of the coil windings (4), characterized in that the coil windings (4) are arranged spatially offset to one another by an angle (41) of $2\pi/N$, and the cooling plate (2) has a cooling channel (24) which extends at least partially around each of the N coil windings (24).

In some embodiments, there are exactly three coil windings (4).

In some embodiments, the cooling channel (6) extends around the respective coil winding (4) over an angle (41) of at least $5\pi/3$, in particular at least $11\pi/6$, and/or $2\pi$.

In some embodiments, the cross-section of the cooling channel (24) is enlarged in the region of the coil windings (4).

In some embodiments, the cooling plate (2) is designed in the form or shape of a triangle.

In some embodiments, the cooling plate (2) has three side edges (21, 22, 23), wherein the cooling channel (24) extends along two side edges (21, 22) of the three side edges (21, 22, 23).

In some embodiments, the cooling plate (2) has at least one opening (8), in particular a slot.

In some embodiments, the opening (8) is designed in the form or shape of a star.

In some embodiments, the opening (8) is formed from a plurality of slots (81), wherein the slots (81) extend in the form of a star in different directions from a shared center (800).

In some embodiments, the cooling channel (24) extends in the form of a tab between the slots (81).

In some embodiments, the cooling plate (2) is arranged on winding cores of the coil windings (4), wherein that side face of the cooling plate (2) which faces towards the winding cores has an electrically insulating layer (14) or coating.

In some embodiments, that side face of the cooling plate (2) which faces away from the winding cores has an electrically insulating layer (16) or coating.

In some embodiments, the cooling plate (2) is made of aluminum, copper, stainless steel, copper nickel ferrite, or a mixture thereof.

In some embodiments, each of the coil windings (4) has a contacting element (10) for the purpose of electrical contacting, wherein each of the contacting elements (10) is surrounded at least partially by the cooling channel (24).

In some embodiments, the contacting elements (10) are designed as copper tabs.

BRIEF DESCRIPTION OF THE DRAWINGS

Further advantages, features, and details of the teachings herein are derived from the exemplary embodiments described below and with reference to the drawings, in which.

Similar, equivalent or functionally identical elements may be denoted by the same reference characters in the figures.

DETAILED DESCRIPTION

Figure 1:
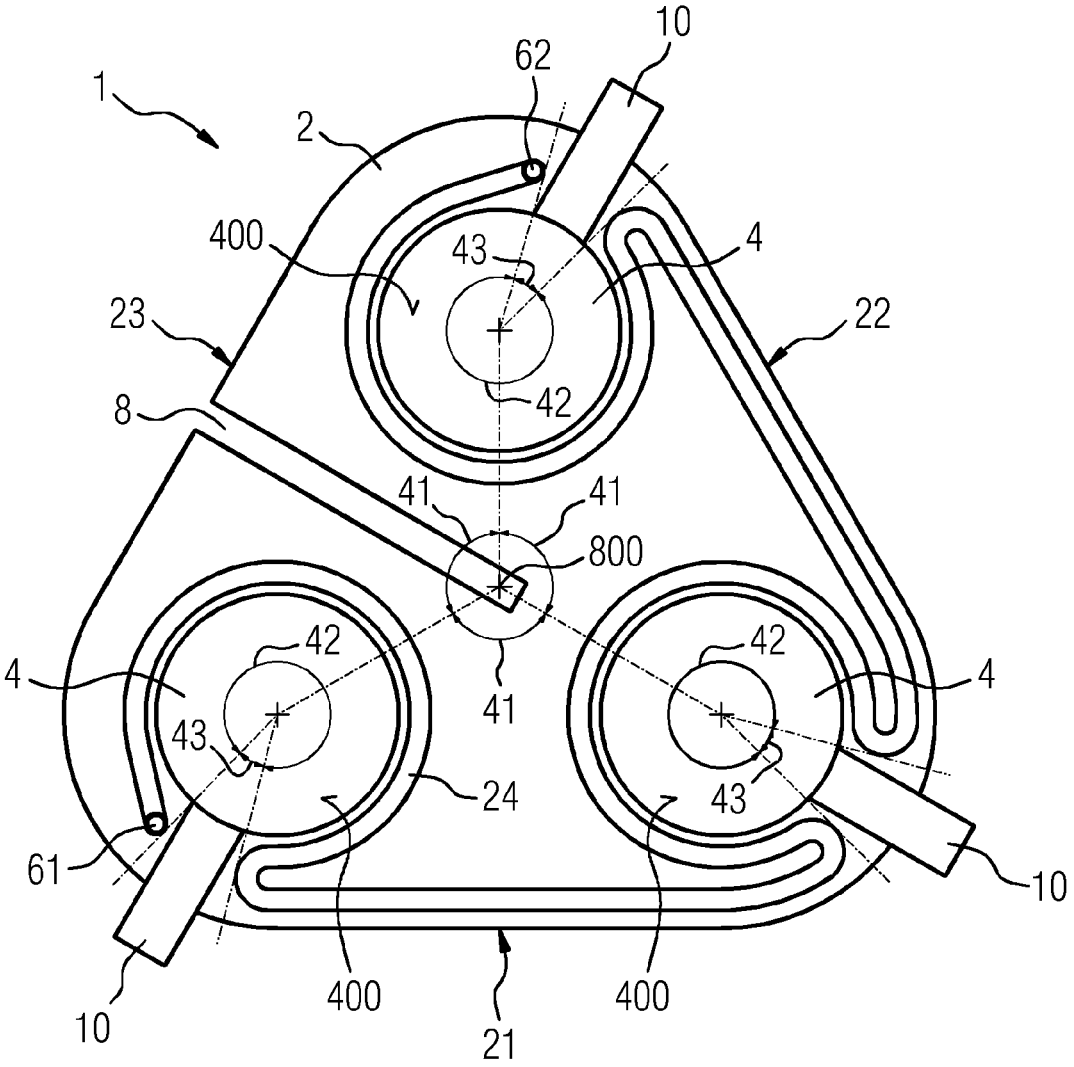
FIG. 1 shows a schematic plan view of a coil device incorporating teachings of the present disclosure, with a cooling plate in the form of a triangle.

Various embodiments include a coil device for a power converter comprises a cooling plate and a plurality N≥3 of coil windings, wherein the cooling plate is thermally coupled to at least one end face of one of the coil windings. In some embodiments, the coil windings are arranged spatially offset to one another by an angle of $2\pi/N(=360°/N)$ and the cooling plate has a cooling channel which extends at least partially around each of the coil windings.

In other words, the coil device has at least two coil windings. The cooling channel here extends around each of the two coil windings. An improved heat dissipation of the coil windings may be achieved thereby. The end face of the coil winding typically has a sufficiently large surface and is therefore well suited for the heat dissipation of the coil windings.

In some embodiments, the symmetrical structure of the coil device, which is produced by the spatial arrangement of the coil windings in an angle of $2\pi/N$, results in an arrangement which may enhance the cooling of the coil device in particular.

In some embodiments, the cooling plate and the cooling channel thereof can be manufactured by means of a regenerative method, for example, in particular 3D printing. Moreover, the cooling channel is suitable for containing a coolant, e.g. water and in particular a fluoroketone, for cooling or heat dissipation of the coil device. In some embodiments, the coolant provided for the cooling is not electrically conductive. It is thereby possible advantageously to reduce eddy currents within the cooling plate.

In some embodiments, heat dissipation is provided for all coil windings of the coil device by means of a shared cooling channel. In some embodiments, the cooling channel extends at least partially around each of the coil windings. It is thereby possible to achieve a mechanically advantageous and compact structural format of the coil device.

In some embodiments, the mechanical stability of the coil device is improved by the cooling plate. For example, the coil device can be compressed by means of the cooling plate or a plurality of cooling plates, such that the weight of the inventive coil device is reduced and structural space can also be economized.

In some embodiments, the coil device comprises exactly three coil windings. In particular, the three coil windings correspond to the three known phases of the three-phase alternating current. In other words, a coil device is provided for each phase of the three-phase alternating current. In some embodiments, the coil device can therefore be used for a power converter, in particular a current converter.

In some embodiments, the course of the cooling channel here extends as far and as closely as possible around the coil windings. The heat dissipation of the coil device may be thereby improved by means of the cooling plate. In some embodiments, the cooling channel here extends around the respective coil winding over an angle of at least $5\pi/3$ (=300°), in particular $11\pi/6$ (=330°), and most preferably $2\pi$(=360°). In other words, this may result in an angular range around the coil winding of at most $\pi/3$ (=60°), in particular at most $\pi/6$ (=30°), in which it is not surrounded by the cooling channel. The heat dissipation of the coil device, in particular the coil windings thereof, may be further improved thereby.

In some embodiments, the cross-section of the cooling channel is enlarged in the region of the coil winding. As a result of the enlarged cross-section of the cooling channel in the region of the coil winding, it may be possible to carry more heat away from the coil windings. The heat dissipation of the coil device and/or the coil windings is thereby further improved overall.

In some embodiments, the cooling plate is designed in the form or shape of a triangle. This may produce a symmetrical embodiment of the cooling plate, for exactly three coil windings in particular. The geometric shape or the geometric embodiment of the cooling plate is therefore adapted to exactly three coil windings. Structural space can be economized thereby. In particular, provision is made here for the corners of the cooling plate in the form or shape of a triangle to be rounded off such that further structural space can be economized.

In some embodiments, the cooling plate has three side edges, wherein the cooling channel extends along two of the three side edges. As a result, the heat may be released into the surroundings of the cooling plate via at least two of the side edges. The forward flow and the return flow from the cooling channel and/or further mechanical, electrical, thermal, and/or fluidic connections for the coil device may be provided at the further side edge, along which the cooling channel does not extend.

In some embodiments, the cooling plate has at least one opening, in particular a slot. The occurrence of eddy currents and the effects thereof may be reduced thereby. By this means, the heat dissipation of the coil device and of the cooling plate may be improved. Furthermore, the efficiency of an electrical machine which comprises e.g. the coil device may be improved.

In some embodiments, the opening here is designed in the form or shape of a star, which may provide reduction of eddy currents within the cooling plate. In some embodiments, the opening may be formed from a plurality of slots here, said slots extending in the form of a star in different directions from a shared center.

In some embodiments, the cooling channel here extends between the slots in the form of a tab. The heat dissipation of the cooling plate may be improved along with a reduction of eddy currents.

This is the case because, by virtue of the cooling channel extending in the form of tab, the length thereof is increased and consequently more heat can be transferred.

In some embodiments, the cooling plate is arranged on winding cores of the coil windings, wherein that side face of the cooling plate which faces towards the winding cores has an electrically insulating layer or coating. In other words, the cooling plate is constructed in at least two parts. The first part of the cooling plate, comprising the cooling channel, may be made of aluminum and/or copper, for example, i.e. a metallic material having good thermal conductivity. A second part of the cooling plate may be formed by the electrically insulating layer or coating. Use may be made of Noryl and/or Ryton for the electrically insulating layer or the coating. The cooling plate may be electrically insulated from live parts of the coil device thereby.

In some embodiments, there is an electrically insulating Thermal Interface Material (TIM) for the electrically insulating layer. In some embodiments, synthetic materials may be used, having low water absorbency, in particular PPS, or a ceramic material, e.g. aluminum nitrate. This allows the coil device to be constructed in a manner which is more cost-efficient overall, wherein the routing of a coolant is arranged in the metallic part (first part) of the cooling plate while the electrically insulating components of the cooling plate (i.e. the electrically insulating layer) are formed by simple end plates without contacting or contouring.

In some embodiments, that side face of the cooling plate which faces away from the winding core has an electrically insulating layer or coating. The winding cores and the coil windings of the coil device can thereby be insulated from a yoke, in particular an iron yoke.

In some embodiments, the cooling plate is made of aluminum, copper, stainless steel, copper nickel ferrite or a mixture thereof. The cooling plate here may comprise further materials or substances, e.g. synthetic materials, in particular PPS, or a ceramic material such as aluminum nitride, for example. The cited metallic materials, i.e. aluminum, copper, stainless steel or copper nickel ferrite, exhibit a high thermal conductivity, and therefore the thermal heat dissipation of the coil device or the cooling plate may be improved.

In some embodiments, each of the coil windings has a contacting element for electrical contacting, wherein each of the contacting elements is surrounded at least partially by the cooling channel. The heat dissipation of the coil device and of the cooling plate may be further improved thereby. In particular, at least partial heat dissipation of the contacting elements is therefore likewise effected by the cooling channel, which at least partially surrounds them.

In some embodiments, the contacting elements comprise copper tabs, in particular curved copper tabs. This may cause the electrical contacting of the coil device to be improved and the thermal conductivity of the contacting elements to be increased.

FIG. 1 shows a schematic plan view of a coil device 1 incorporating teachings of the present disclosure. The coil device 1 here comprises a cooling plate 2 which has a cooling channel 24. The cooling channel 24 is designed and intended for routing a coolant, e.g. water or a fluid containing a fluoroketone in particular. For this purpose, the cooling channel 24 has a forward flow 61 and a return flow 62.

The cooling plate 2 of the coil device 1 is designed in the form of a triangle. The cooling plate 2 here has three side edges 21, 22, 23 forming the sides of a notional isosceles triangle. The corners of the notional isosceles triangle are rounded off here, such that structural space is economized. In addition, the rounded-off corners can reduce eddy currents within the cooling plate 2.

In order to further reduce eddy currents, provision is made for an opening 8 in the form of a slot. The slot 8, which is so designed as to be elongated, extends here from a center 800 of the cooling plate 2, in particular a symmetry center of the cooling plate 2, to the third side edge 23 of the cooling plate 2. Furthermore, the opening 8 is situated between two sections of the cooling channel 24.

The coil device 1 comprises three coil windings 4, these being designed to have a circular cross-section in the illustrated figure. The coil windings 4 also have an end face 400, e.g. in the form of an end face of a winding core which is assigned to the respective coil winding 4.

The coil windings 4 are arranged symmetrically relative to each other. Here, the coil windings 4 are at an angle 41 of $2\pi/3$ (=120°) relative to each other. In other words, the coil windings 4 are arranged spatially offset to one another by the angle 41 of $2\pi/3$. The angle 41 here relates to the shared center 800. In other words, the coil windings 4 are essentially arranged in the region of the rounded-off corners of the cooling plate 2, which is in the form of a triangle.

The cooling channel 24 extends at least partially along the coil windings 4. The cooling channel 24 may extend almost completely along the coil windings 4. In other words, the coil windings 4 are surrounded by the cooling channel 24 with the exception of an angle 43. Corresponding to the angle 43, the cooling channel extends around the respective coil winding 4 at least over an angle 42 of at least $5\pi/3$, in particular at least $11\pi/3$, and most preferably $2\pi$. The angle 43 results in an opening of an angular range of the coil winding 4, which angular range is not surrounded by the cooling channel 24 and corresponds to the angle 43. In other words, an angular sum of the angle 42 and the angle 43 has the value $2\pi$. The angular range which corresponds to the angle 43 can be used for electrical contacting by means of contacting elements 10, in particular by means of a curved copper tab.

The course of the cooling channel 24 may allow heat dissipation from the coil devices 4 by means of the cooling plate 2. The cooling plate 2 also increases and improves the mechanical stability of the coil device 1. Furthermore, structural space and weight can be economized by pressing the coil device 1 together, e.g. by means of the cooling plate 2. In other words, the cooling plate 2 allows the coil device 1 to be compressed. In addition, said compression of the cooling plate 2 with the end faces 400 of the coil devices 4 is simplified.

Figure 2:
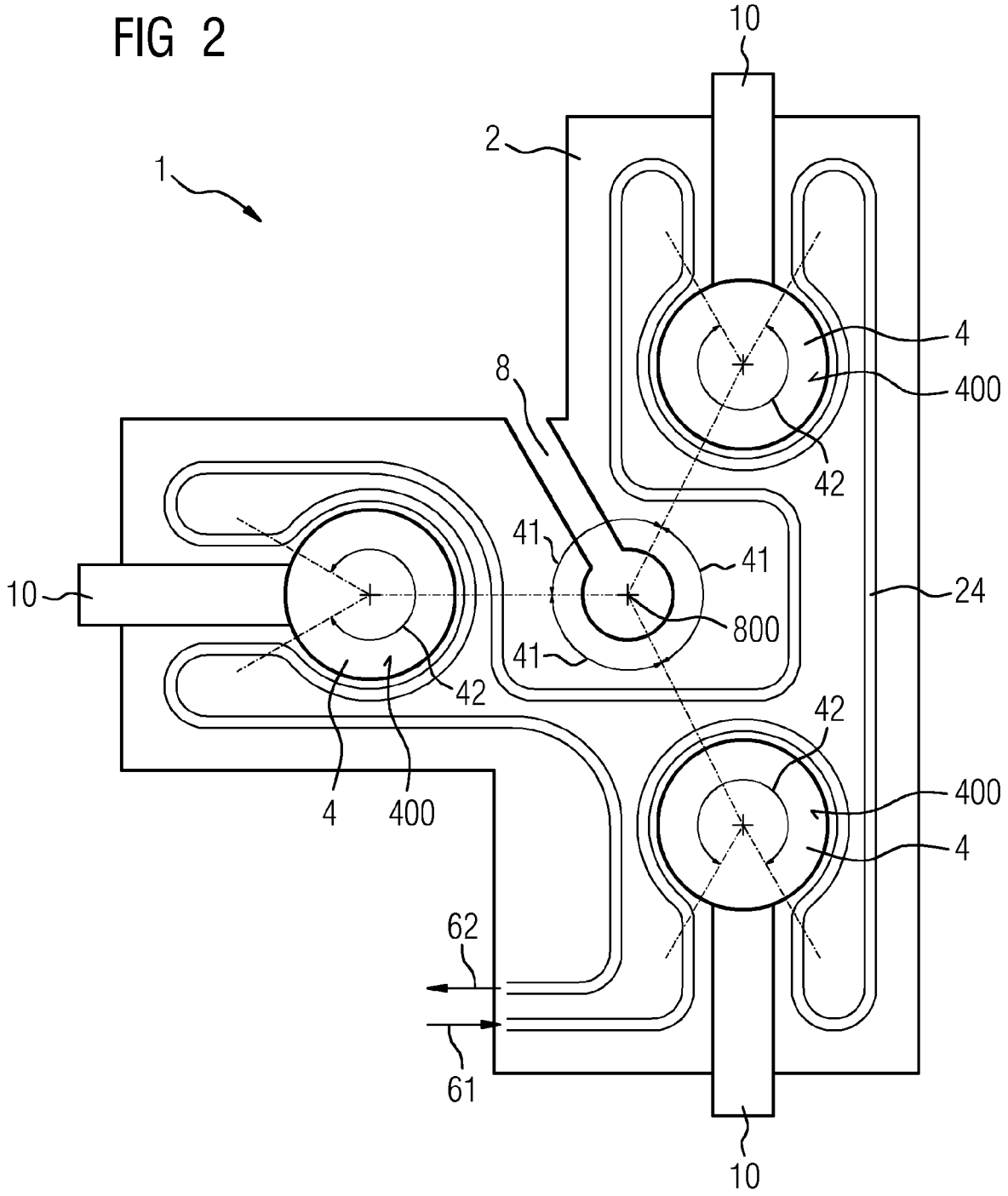
FIG. 2 shows a further schematic plan view of a coil device incorporating teachings of the present disclosure, wherein a cooling plate of the coil device is designed in the shape of a T.

FIG. 2 shows a plan view of an example coil device 1 which is comparable with the coil device illustrated in FIG. 1. In other words, the statements made in respect of FIG. 1 can be applied and transferred to FIG. 2. The coil device 1 in FIG. 2 has a cooling plate 2 in the form or shape of a T. Furthermore, Figure shows a more complex arrangement and course of the cooling channel 24. This extends in a meandering manner within the cooling plate 2 around the coil devices 4. The meandering arrangement of the cooling channel 24 may improve the heat dissipation of the cooling plate 2 and consequently of the coil device 1. In addition, the forward flow 61 and the return flow 62 of the cooling channel 24 can be arranged in a shared region of the cooling plate 2, such that their fluidic attachment is simplified.

As in FIG. 1, the coil device in FIG. 2 has an opening 8, which extends radially outwards from a center 800. A circular opening within the center 800 is provided here. It is thereby possible to mount the cooling plate 2 on a shared shaft, which is provided for the purpose of arranging the coil devices 4. Moreover, compression of the cooling plate 2 with the end faces 400 of the coil devices 4 is thereby simplified.

Figure 3:
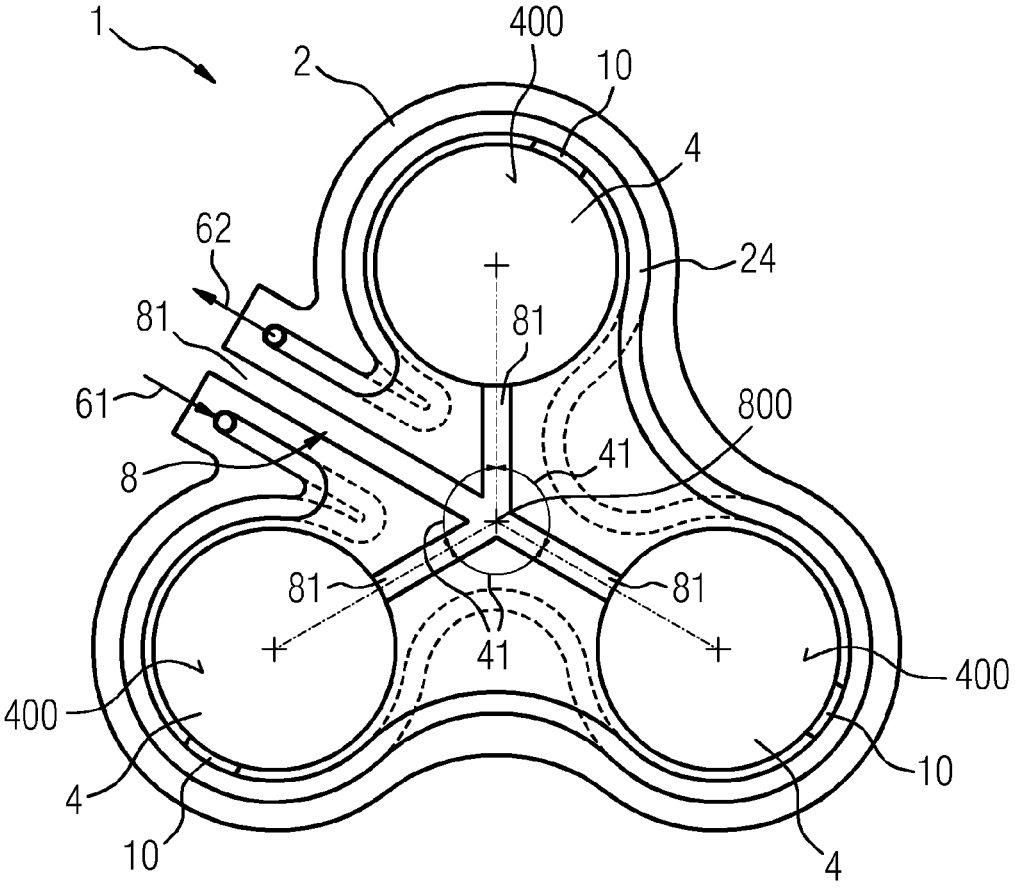
FIG. 3 shows a further plan view of a coil device incorporating teachings of the present disclosure, wherein the cooling plate here is designed in the form of a star.

FIG. 3 illustrates a further plan view of a coil device 1 incorporating teachings of the present disclosure. FIG. 3 here shows substantially the same elements as shown in FIG. 1 and/or FIG. 2. In contrast with FIG. 1 and/or FIG. 2, FIG. 3 shows a cooling plate 2 in the form or shape of a star. Further structural space can be economized thereby. The cooling plate 2 again has a cooling channel 24, which extends at least partially around the coil windings 4 of the coil devices 1. The forward flow 61 and the return flow 62 of the cooling channel 24 here are arranged within a shared region, such that their fluidic attachment is simplified and improved.

The coil device 1 has an opening 8 which is designed in the form or shape of a star. For this, it has a plurality of elongated slots 81 which extend in different directions from the shared center 800. The formation of eddy currents may be significantly reduced thereby. One of the slots 81 here is arranged between the forward flow 61 and the return flow 62 of the cooling channel 24. In other words, the forward flow 61 and the return flow 62 are separated by one of the slots 81. The broken lines correspond to an alternative course of the cooling channel 24. Here, the cooling channel 24 extends in the form of a tab between two adjacent slots 81 in each case. The heat dissipation of the coil device may be improved thereby.

The coil device 1 also has contacting elements 10, in particular copper tabs, which are arranged between the coil devices 4 and the cooling channel 24. The cooling channel 24 here extends along the contacting elements 10, such that these are cooled by the cooling channel 24 or by a coolant which is held within or flows through the cooling channel 24.

Figure 4:
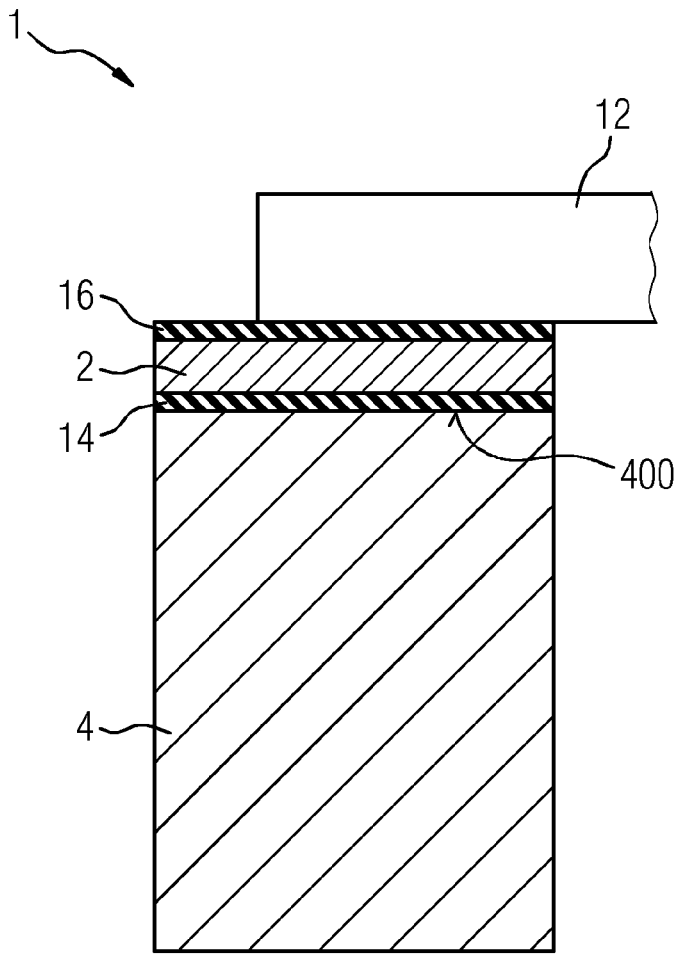
FIG. 4 shows a lateral representation of a coil device incorporating teachings of the present disclosure.

FIG. 4 illustrates a lateral sectional representation of part of a coil device 1 incorporating teachings of the present disclosure. Here, one of the coil devices 4 and the cooling plate 24 can be seen in the illustrated section. An electrically insulating coating 14 is arranged or deposited on that side of the cooling plate 24 which faces towards the coil winding 4. This ensures that the cooling plate 24 is electrically insulated from the live parts of the coil winding 4. Here, the electrically insulating material or the insulating coating 14 can be made of e.g. a synthetic material having low water absorbency, in particular PPS, or a ceramic material, e.g. aluminum nitrate. Furthermore, an arrangement using a silicone layer may because this can level out any unevennesses in the coil winding 4 and/or the cooling plate 24.

A further electrically insulating layer or coating 16 may be applied to that side of the cooling plate 2 which faces away from the coil winding 4. As per the electrically insulating layer 14, this can be made of a synthetic material having low water absorbency, in particular PPS, or a ceramic material, e.g. aluminum nitrate. The further electrically insulating layer 16 is intended to provide electrical insulation from an iron yoke 12 of the coil device 1.

Although the teachings herein are illustrated and described in detail by means of the exemplary embodiments above, the scope is not restricted by the examples disclosed herein, and other variations may be derived therefrom by a person skilled in the art without thereby departing from the scope of the teachings.

What is claimed is:

1. A coil device for a power converter, the device comprising:

a cooling plate; and a plurality $N \geq 3$ of coil windings;

wherein the cooling plate is thermally coupled to at least one end face of one of the plurality of coil windings;

the coil windings are spatially offset from one another by an angle of $2\pi/N$; and the cooling plate defines a cooling channel extending at least partially around each of the plurality of coil windings.

2. The coil device as claimed in claim 1, comprising exactly three coil windings.

3. The coil device as claimed in claim 1, wherein the cooling channel extends around the respective coil winding over an angle of at least $5\pi/3$.

4. The coil device as claimed in claim 1, wherein a cross-section of the cooling channel is greatest in a region of the coil windings.

5. The coil device as claimed in claim 1, wherein the cooling plate comprises a triangle.

6. The coil device as claimed in claim 5, wherein:

the cooling plate includes three side edges; and the cooling channel extends along two of the three side edges.

7. The coil device as claimed in claim 1, wherein the cooling plate comprises an opening.

8. The coil device as claimed in claim 7, wherein the opening comprises a star-shaped opening.

9. The coil device as claimed in claim 8, wherein the opening comprises a plurality of slots extending in a star-shape in different directions from a shared center.

10. The coil device as claimed in claim 9, wherein the cooling channel extends in a tab form between the individual slots of the plurality of slots.

11. The coil device as claimed in claim 1, wherein:

the cooling plate is arranged on winding cores of the coil windings; and a side face of the cooling plate facing towards the winding cores includes an electrically insulating layer or coating.

12. The coil device as claimed in claim 11, wherein a second side face of the cooling plate facing away from the winding cores includes an electrically insulating layer or coating.

13. The coil device as claimed in claim 1, wherein the cooling plate comprises at least one material chosen from the group consisting of: aluminum, copper, stainless steel, and copper nickel ferrite.

14. The coil device as claimed in claim 1, wherein each of the coil windings includes an associated contacting element each surrounded at least partially by the cooling channel.

15. The coil device as claimed in claim 14, wherein each of the contacting elements comprises a copper tab.

* * * * *